US008091806B2

(12) United States Patent
Huang

(10) Patent No.: US 8,091,806 B2
(45) Date of Patent: Jan. 10, 2012

(54) REMOVABLE SPREAD HEAD

(75) Inventor: Nan-Hai Huang, Shenzhen (CN)

(73) Assignee: Globe Union Industrial Corp., Taichung (TW)

( * ) Notice: Subject to any disclaimer, the term of this patent is extended or adjusted under 35 U.S.C. 154(b) by 362 days.

(21) Appl. No.: 12/548,464

(22) Filed: Aug. 27, 2009

(65) Prior Publication Data

US 2011/0049273 A1 Mar. 3, 2011

(51) Int. Cl.

| | |
|---|---|
| ***A62C 31/02*** | (2006.01) |
| ***A62C 31/00*** | (2006.01) |
| ***A62C 37/20*** | (2006.01) |
| ***B05B 1/30*** | (2006.01) |

(52) U.S. Cl. ..... 239/447; 239/390; 239/396; 239/443; 239/444; 239/445; 239/562; 239/583

(58) Field of Classification Search ..... 239/390, 239/391, 396, 443, 444, 445, 446, 447, 525, 239/548, 562, 583, 588; 4/678; 137/801
See application file for complete search history.

(56) References Cited

U.S. PATENT DOCUMENTS

| | | | | |
|---|---|---|---|---|
| 6,085,790 | A * | 7/2000 | Humpert et al. | 137/801 |
| 6,151,729 | A * | 11/2000 | Yean | 4/675 |
| 6,370,713 | B2 * | 4/2002 | Bosio | 4/677 |
| 7,344,095 | B1 * | 3/2008 | Hsu | 239/589 |
| 7,380,731 | B1 * | 6/2008 | Hsu | 239/447 |
| 7,494,074 | B2 * | 2/2009 | Benstead | 239/449 |

* cited by examiner

*Primary Examiner* — Jason Boeckmann
*Assistant Examiner* — Ryan Reis

(57) ABSTRACT

A movable spread head comprises a tubular member, a watering member, a valve core, a housing, a front cover, a control member, and a first and a second watering elements. The valve core is axially installed on a front end of the tubular member, the control member is located on a top end of the housing and includes a first and a second press portions to be selectively pressed to generate a levering action, such that the valve core is actuated to move axially to engage with the tubular member or the watering member tightly, so that water flow from an outlet of the tubular member is guided to one of first and second water orifices to flow outward from one of the first and the second watering elements, thereby decreasing related components and size, simplifying structure, and operating the movable spread head easily.

11 Claims, 11 Drawing Sheets

REMOVABLE SPREAD HEAD

BACKGROUND OF THE INVENTION

1. Field of the Invention

The present invention relates to a movable spread head that can decrease related components and size, simplify structure, and be operates easily.

2. Description of the Prior Art

Conventional pulled spread head disclosed in U.S. Pat. No. 6,370,713 includes a control member to be pressed to push a watering element of a shaft to engage with one of two sealing surfaces so that water flow in a body is guided to a central hole or peripheral bores to generate centrally or peripherally jetted water flow.

However, such a spread head is made in large size, limited to flow water and operated difficultly.

In addition, another conventional spread head disclosed in CA Pat. No. 2448878 is used to flow water from a central water filter or a peripheral jetted loop, however such a spread head is made in large size, limited to flow water and operated difficultly as well.

The present invention has arisen to mitigate and/or obviate the afore-described disadvantages.

SUMMARY OF THE INVENTION

The primary object of the present invention is to provide a movable spread head which is capable of overcoming the shortcomings of the conventional spread head.

Another object of the present invention is to provide a movable spread head which can decrease related components and size, simplify structure, and operate the movable spread head easily.

A movable spread head in accordance with a preferred embodiment of the present invention comprises:

a tubular member including a channel, an inlet and an outlet, both of which are disposed on two ends of the channel respectively; the inlet coupled with a soft pipe in a water tap, the channel including a large diameter first passageway and a small diameter second passageway, and on an outer side of the first passageway being formed the inlet, on an outer side of the second passageway being formed the outlet; the tubular member also including an insulation rim extending on a peripheral wall of the outlet, the second passageway defined between a lower side of the insulation rim and the peripheral wall; the tubular member including an opening mounted on the peripheral wall above an upper side of the insulation rim so that a receiving groove is defined between the opening and the upper side of the insulation rim, and between the upper side of the insulation rim and the peripheral wall being also fixed a hole and an inner chamber, and the hole communicating with the receiving groove; the inner chamber including a first sealing surface arranged on a predetermined position of an outer side thereof; the tubular member further including a first closing portion and a second closing portion secured on an outer surface of the peripheral rim, and including at least one cutout disposed between the first and the second closing portions and to communicate with the inner chamber;

a watering member including a first cavity and a second cavity communicating with each other, a first water orifice and a second water orifice spaced apart from each other; the first water orifice being in communication with the first cavity and the second water orifice communicating with the second cavity, and a periphery of the first cavity engaged with the first and second closing portions of the tubular member, and a bottom wall of the first cavity keeping a certain distance away from the tubular member so that the first cavity communicates with the outlet, and the water orifice communicates with the inner chamber through the cutout, and a second sealing surface formed in the second cavity;

a valve core formed in a post shape and inserting to the inner chamber and the hole of the tubular member axially, the valve core including a third closing portion attached on a central section thereof to retain the hole, and including a fourth closing portion arranged on an outer surface thereof, and a connecting portion disposed on an inner end thereof, such that the connecting portion is forced to actuate the valve core to move along the hole axially; as the fixing portion moves inward, the fourth closing portion abuts against the first sealing surface of the inner chamber so that the outlet of the tubular member communicates with the second water orifice via the first cavity and second cavity in order; as the fixing portion moves outward, the fourth closing portion abuts against the second sealing surface of the first cavity so that the outlet of the tubular member communicates with the second water orifice via the first cavity and second cavity in turn;

an elastic element to push the valve core outward so that the fourth closing portion engages with the second sealing surface of the watering member;

a housing including an internal room to receive the tubular member and the watering member; the internal room communicating with a side pore and a lower vacancy, the tubular member extending out of the side pore, the housing further including an installing space to couple with the tubular member and the watering member, and the installing space including a rotary shaft;

a front cover installed in the vacancy of the housing and coupled to the watering member to be proximate to a first compartment and a second compartment to communicate with the first and the second water orifices respectively;

a first watering element installed in the first compartment of the front cover, such that water flowing from the first water orifice forms a first mode of water flow;

a second watering element installed in the second compartment of the front cover, such that the water flowing from the second water orifice forms a second mode of water flow;

a control member including a coupling section disposed on a central portion thereof and an actuating portion formed on a front side thereof individually, and including a first press portion and a second press portion mounted on a top of a rear side and the front side thereof individually; the coupling section axially connected with the rotary shaft of the installing space of the housing to form a fulcrum to rotate the housing frontward and rearward; the actuating section passing through the installing space of the housing to connect with and actuate the connecting portion of the valve core.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
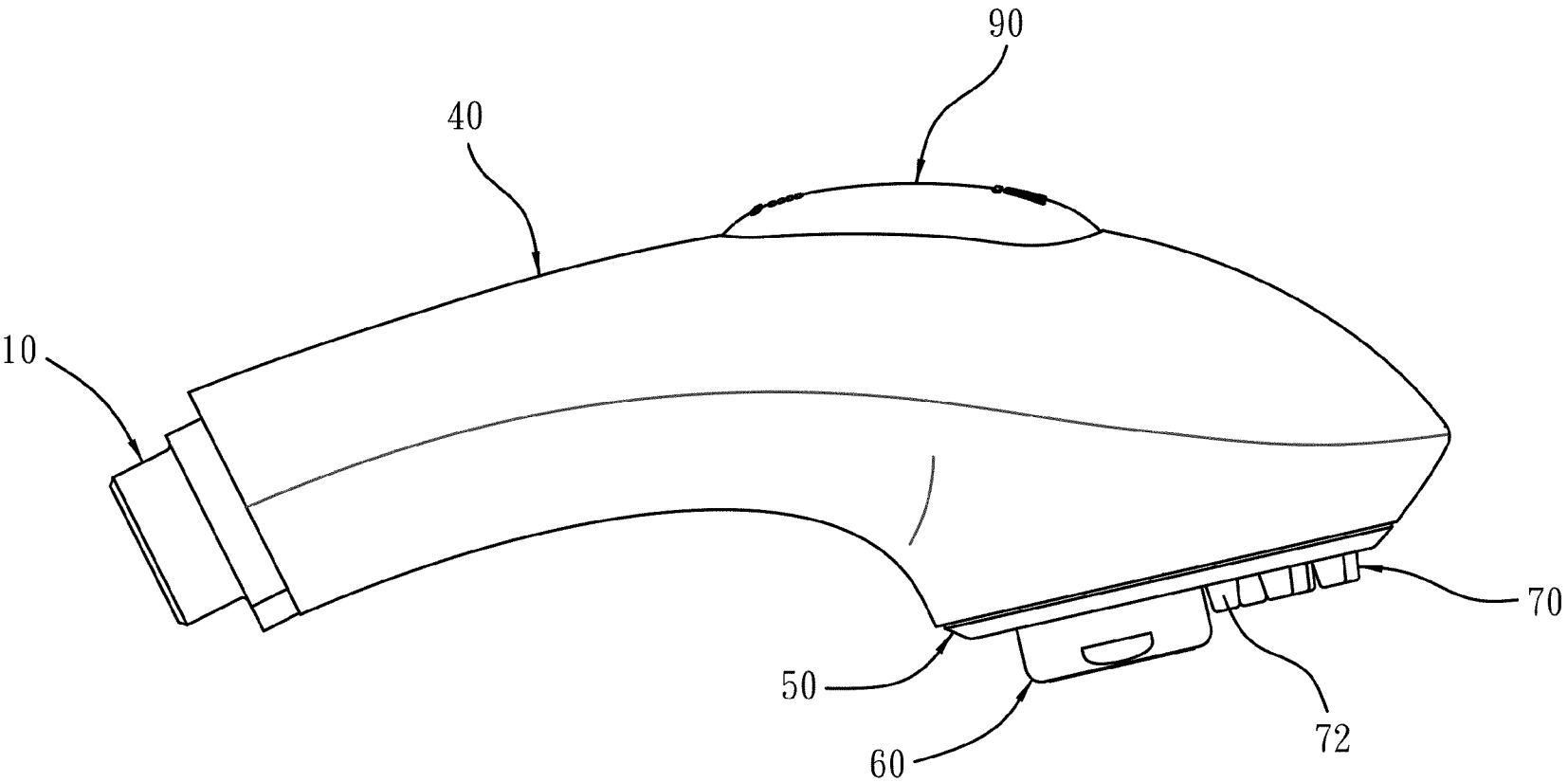
FIG. 1 is a perspective view showing the assembly of a movable spread head in accordance with a preferred embodiment of the present invention.
Figure 2:
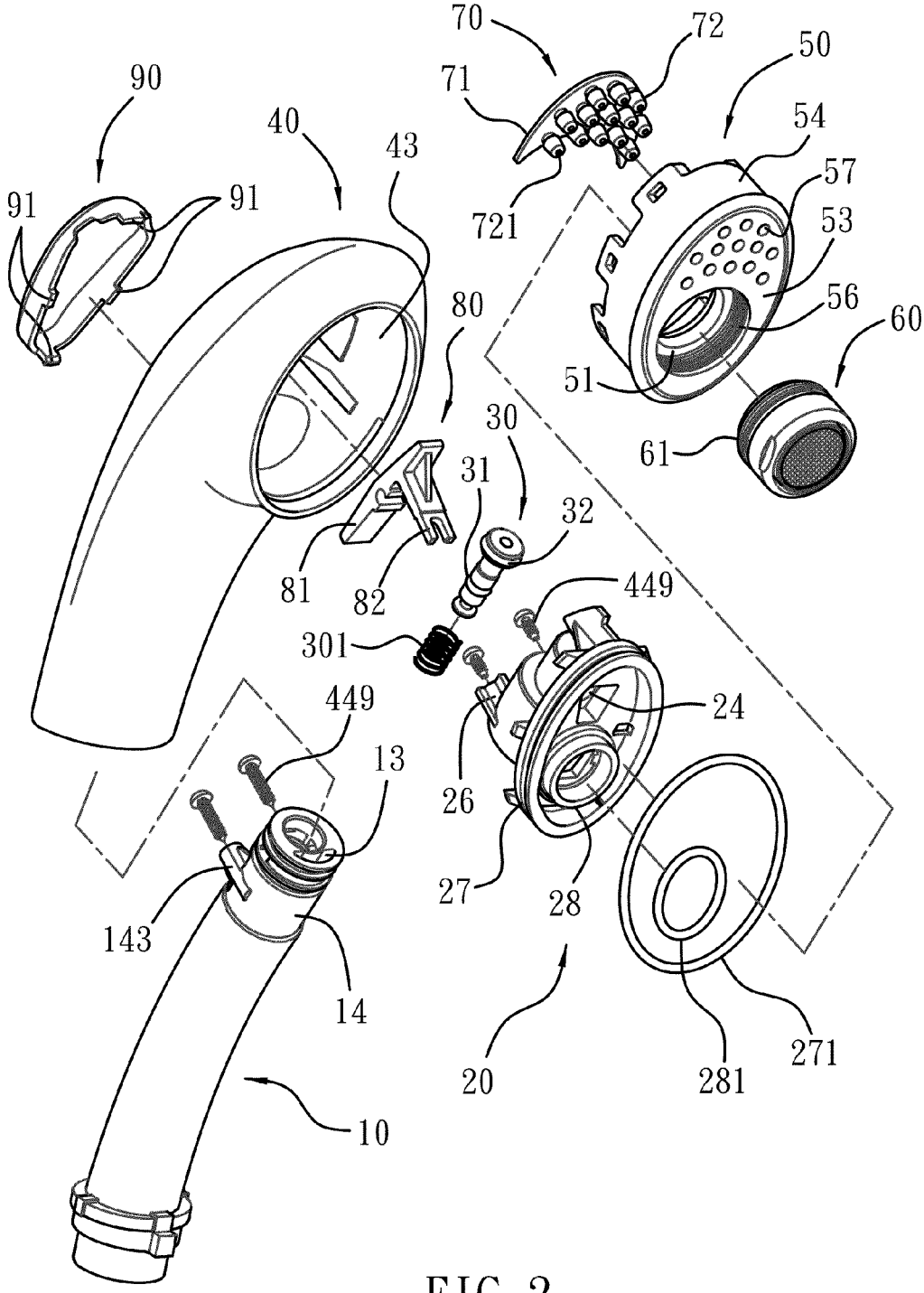
FIG. 2 is a perspective view showing the exploded components of the movable spread head in accordance with the preferred embodiment of the present invention.
Figure 3:
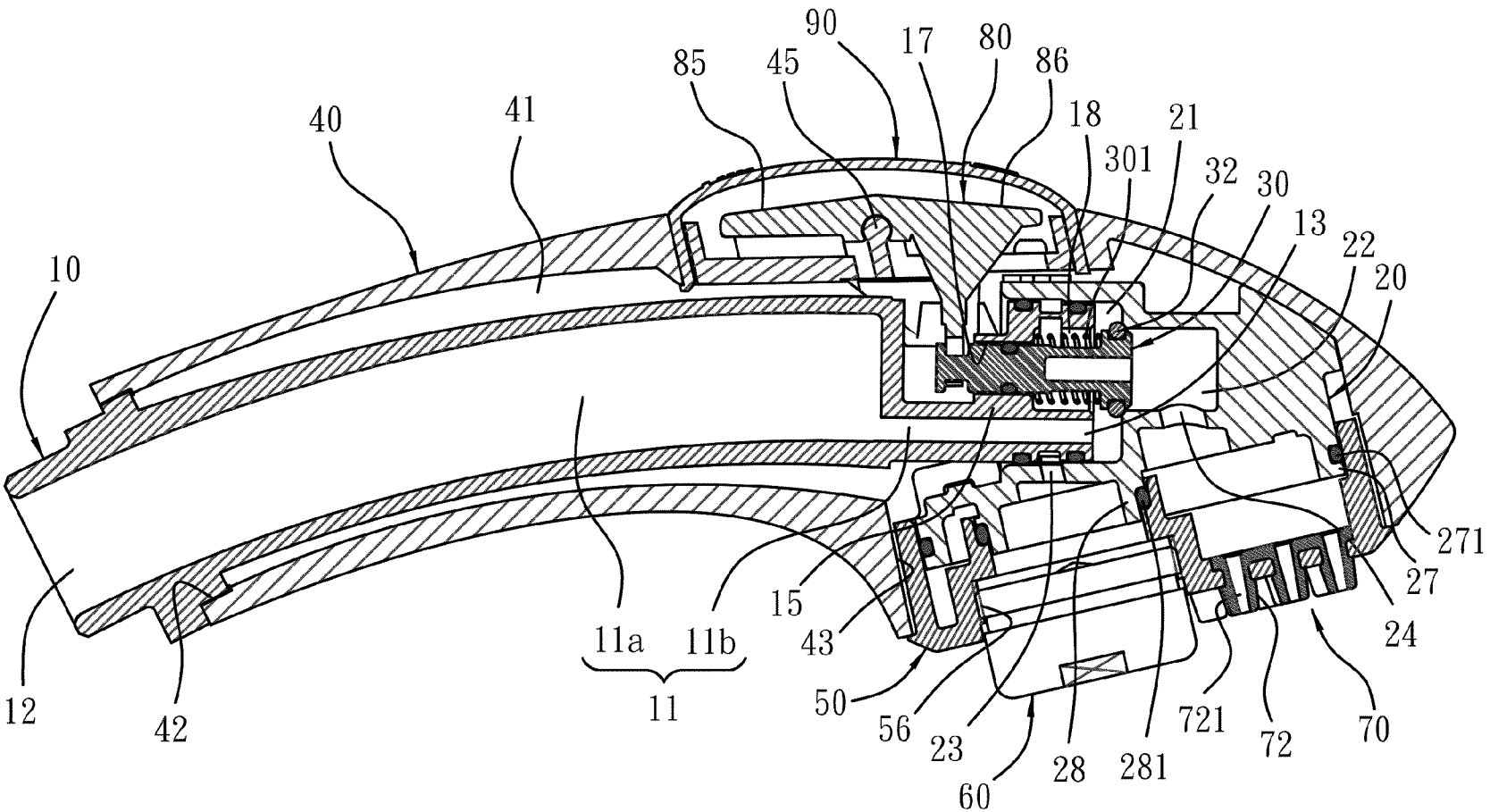
FIG. 3 is a cross sectional view showing the assembly of the movable spread head in accordance with the preferred embodiment of the present invention.

Referring to FIGS. 1-3, a movable spread head according to a preferred embodiment of the present invention comprises a tubular member 10, a watering member 20, a valve core 30, a housing 40, a front cover 50, a first watering element 60, a second watering element 70, a control member 80, and a sleeve 90.

Figure 4:
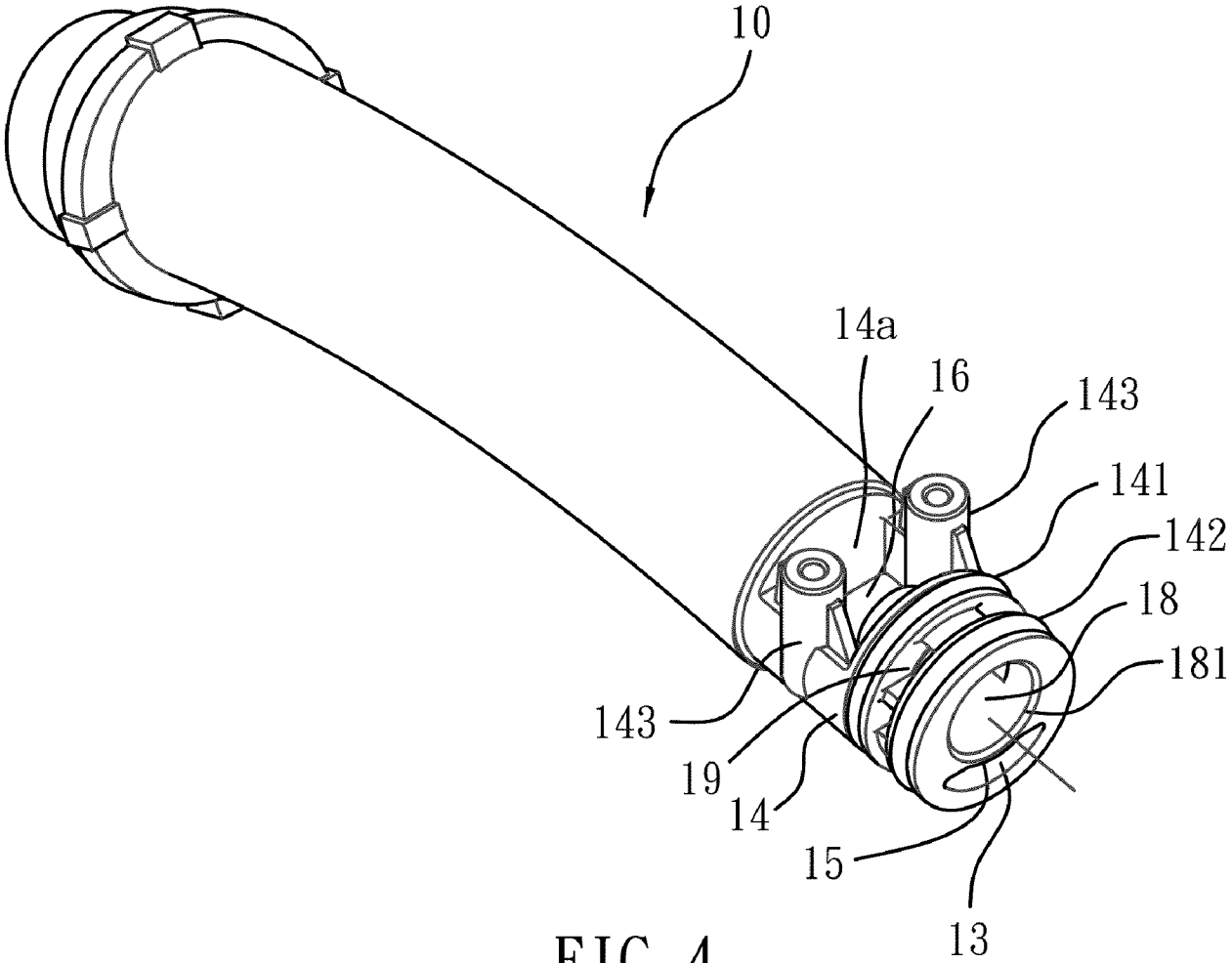
FIG. 4 is a perspective view showing the assembly of a tubular member of the movable spread head in accordance with the preferred embodiment of the present invention.
Figure 5:
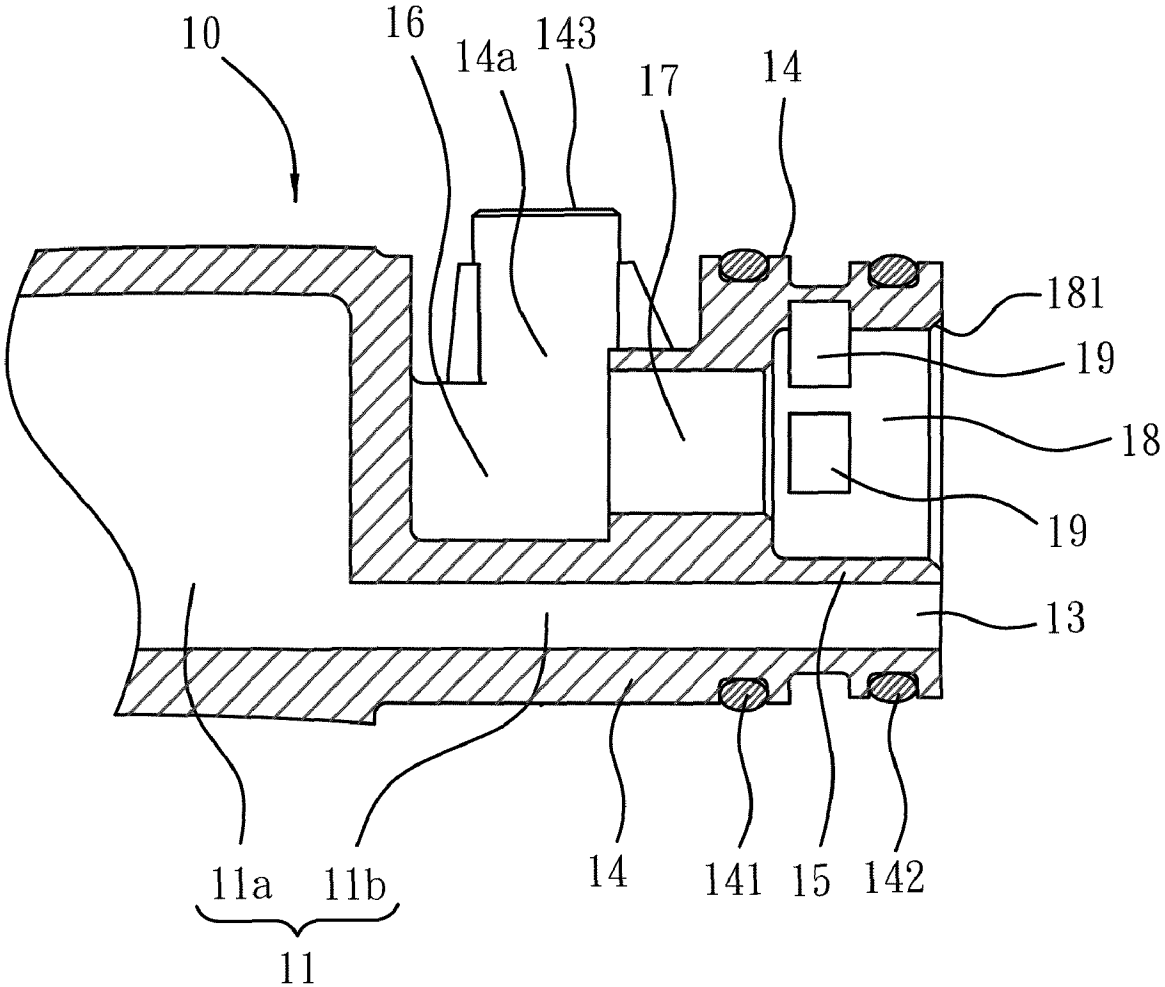
FIG. 5 is a cross sectional view showing the part of the tubular member of the movable spread head in accordance with the preferred embodiment of the present invention.

The tubular member 10 includes a channel 11, an inlet 12 and an outlet 13, both of which are disposed on two ends of the channel 11 respectively; the inlet 12 is coupled with a soft pipe in a water tap, the channel 11 include a large diameter first passageway 11*a* and a small diameter second passageway 11*b*, and on an outer side of the first passageway 11*a* is formed the inlet 12, on an outer side of the second passageway 11*b* is formed the outlet 13; the tubular member 10 also includes an insulation rim 15 extending on a peripheral wall 14 of the outlet 13, as shown in FIGS. 4 and 5, the second passageway 11*b* is defined between a lower side of the insulation rim 15 and the peripheral wall 14; the tubular member 10 includes an opening 14*a* mounted on the peripheral wall 14 above an upper side of the insulation rim 15 so that a receiving groove 16 is defined between the opening 14*a* and the upper side of the insulation rim 15, and between the upper side of the insulation rim 15 and the peripheral wall 14 is also fixed a hole 17 and an inner chamber 18, and the hole 17 communicates with the receiving groove 16; the inner chamber 18 includes a first sealing surface 181 arranged on a predetermined position of an outer side thereof.

The tubular member 10 further includes a first closing portion 141 and a second closing portion 142 secured on an outer surface of the peripheral rim 14, and includes at least one cutout 19 disposed between the first and the second closing portions 141 and 142 to communicate with the inner chamber 18. The first and the second closing portions 141 and 142 are comprised of two annular loop members. The tubular member 10 includes a plurality of first upright posts 143 extending upward from the peripheral wall 14 of the receiving groove 16 to position the housing 40.

Figure 6:
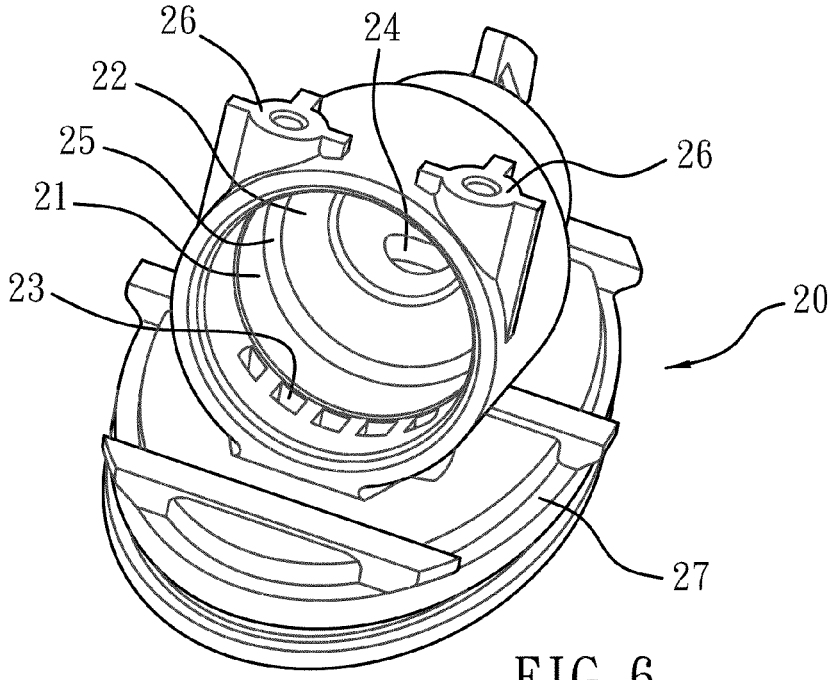
FIG. 6 is a perspective view of the assembly of a watering member of the movable spread head in accordance with the preferred embodiment of the present invention.

The watering member 20 includes a first cavity 21 and a second cavity 22 communicating with each other, a first water orifice 23 and a second water orifice 24 spaced apart from each other as illustrated in FIG. 6; the first water orifice 23 is in communication with the first cavity 21 and the second water orifice 24 communicates with the second cavity 22, and a periphery of the first cavity 21 is engaged with the first and second closing portions 141, 142 of the tubular member 10, and a bottom wall of the first cavity 21 keeps a certain distance away from the tubular member 10 so that the first cavity 21 communicates with the outlet 13, and the water orifice 23 communicates with the inner chamber 18 through the cutout 19. A diameter of the first cavity 21 is larger than that of the second cavity 22, and a second sealing surface 25 is formed in the second cavity 22.

The watering member 20 includes two second upright posts 26 extending upward from a predetermined position thereof relative to an outer surface of an upper side of the first cavity 21 to position the housing 40.

The watering member 20 includes a first outer side 27 extending from a lower side thereof, a second inner side 28 therein, and first and second annular loops 271, 281 fixed on an outer surface thereof individually.

Figure 7:
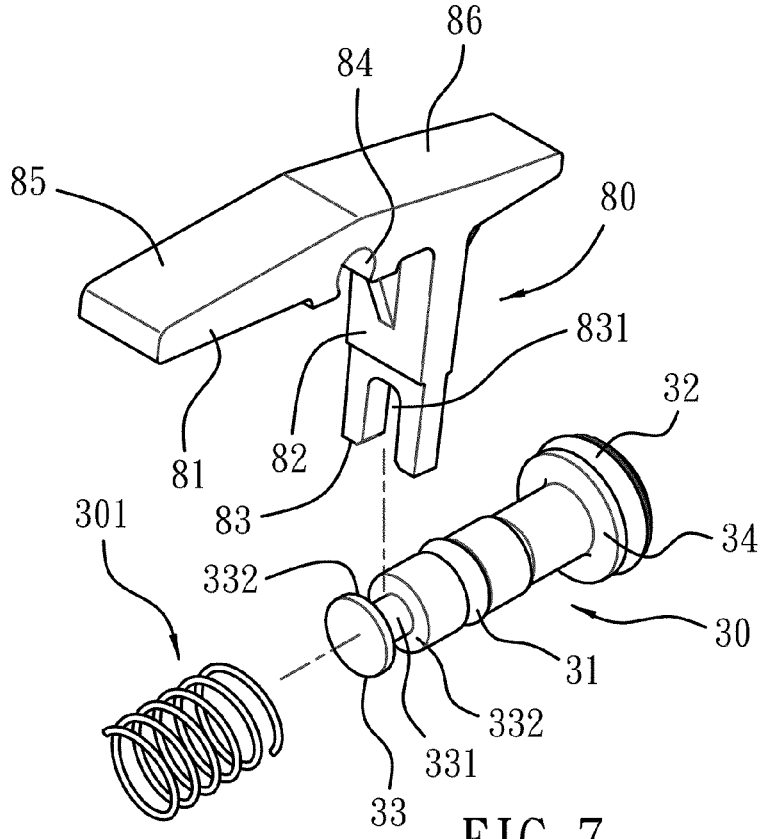
FIG. 7 is a perspective view of a control member, a valve core, and an elastic element of the movable spread head in accordance with the preferred embodiment of the present invention.

The valve core 30 is formed in a post shape and inserts to the inner chamber 18 and the hole 17 of the tubular member 10 axially, the valve core 30 includes a third closing portion 31 attached on a central section thereof to retain the hole 17 as shown in FIG. 7, and includes a fourth closing portion 32 arranged on an outer surface thereof, and a connecting portion 33 disposed on an inner end thereof, such that the connecting portion 33 is forced to actuate the valve core 30 to move along the hole 17 axially.

In addition, the valve core 30 includes a fixing portion 34 mounted on an inner side of the fourth closing portion 32 thereof. As the fixing portion 34 moves inward, the fourth closing portion 32 abuts against the first sealing surface 181 of the inner chamber 18 so that the outlet 13 of the tubular member 10 communicates with the second water orifice 24 via the first cavity 21 and second cavity 22 in order.

The third and the fourth closing portions 31, 32 of the valve core 30 are comprised of two annular loop members fixed on the valve core 30.

The connecting portion 33 of the valve core 30 is comprised of a smaller diameter positioning segment 331 on the valve core 30 and a stop periphery 332 located on two sides of the positioning segment 331.

An elastic element 301 pushes the valve core 30 outward so that the fourth closing portion 32 engages with the second sealing surface 25 of the watering member 20 as illustrated in FIG. 7. The elastic element 301 is a compression spring fitted onto the valve core 30 and is biased against the fixing portion 34 of the valve core 30 by using its two ends and abuts against the inner chamber 18 of the tubular member 10, hence the valve core 30 is pushed outward by the elastic element 301.

Figure 8:
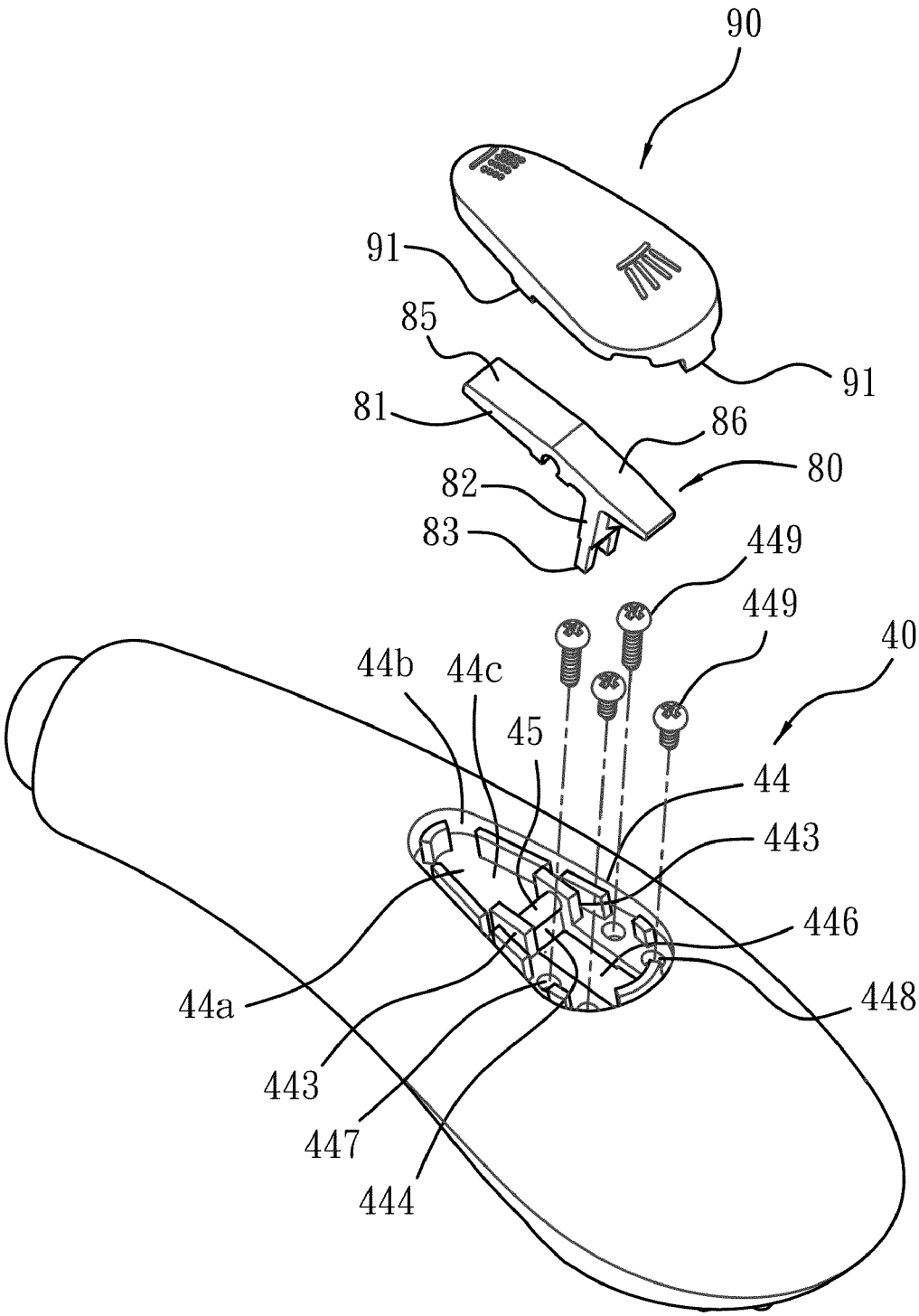
FIG. 8 is a perspective view of a housing, the control member, and a sleeve of the movable spread head in accordance with the preferred embodiment of the present invention.
Figure 9:
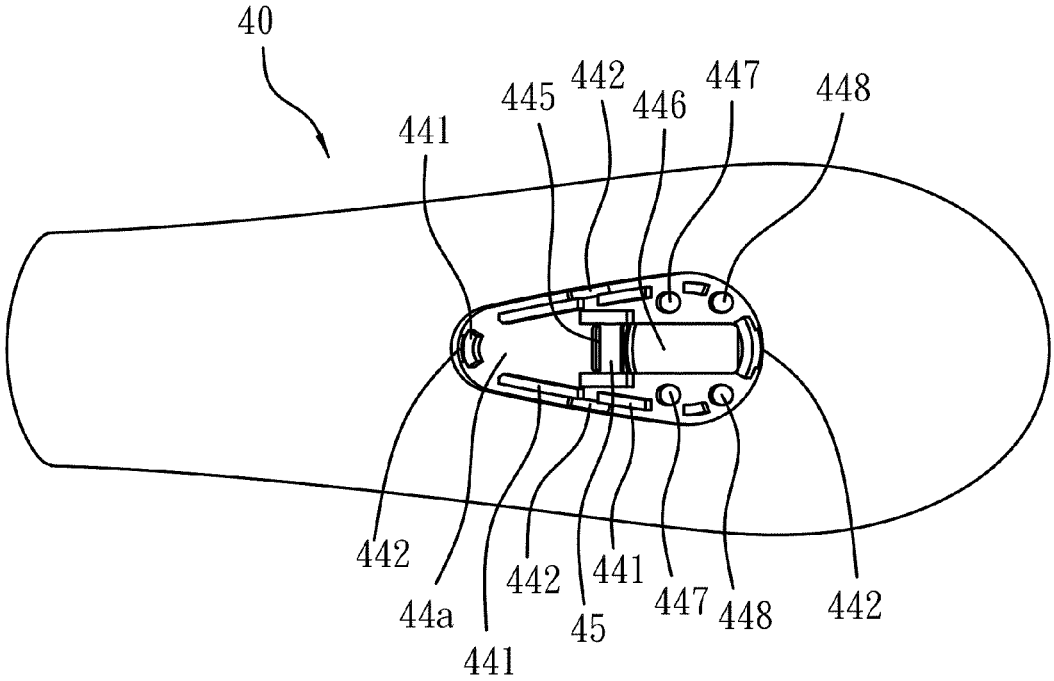
FIG. 9 is a top plan view of the housing of the movable spread head in accordance with the preferred embodiment of the present invention.

The housing 40 includes an internal room 41 to receive the tubular member 10 and the watering member 20, the internal room 41 communicates with a side pore 42 and a lower vacancy 43, the tubular member 10 extends out of the side pore 42, the housing 40 further includes an installing space 44 as illustrated in FIGS. 8-9, to couple with the tubular member 10 and the watering member 20, and the installing space 44 includes a rotary shaft 45.

The installing space 44 includes a bottom surface 44*a* and a side wall 44*b* connected with the bottom surface 44*a*, and a holding area 44*c* between the bottom surface 44*a* and the side wall 44*b*. The bottom surface 44*a* includes a plurality of reinforcement ribs 441 arranged on an inner side of the side wall 44*b* and spaced apart from each other, and a number of inserting holes 442 between the reinforcement ribs 441 and the side wall 44*b*. The installing space 44 includes two projections 443 attached on two sides thereof, a base 444 between the two projections 443, and the rotary shaft 45 between the projections 443 and the base 444. The bottom surface 44*a* includes a mouth 445 between the projections 443 and a slot 446 arranged on a front side thereof to communicate with the receiving groove 16 of the tubular member 10.

The installing space 44 includes a pair of first through apertures 447 and a pair of second through apertures 448 between two sides of the slot 446, wherein the first through apertures 447 screw with the first upright posts 143 of the tubular member 10 by using bolts 449 to lock the tubular member 10 in the housing 40. And the second through apertures 448 screw with the second upright posts 26 of the watering member 20 via the bolts 449 so that the watering member 20 is locked in the housing 40 and the watering member 20 connects with the tubular member 10 securely.

Figure 10:
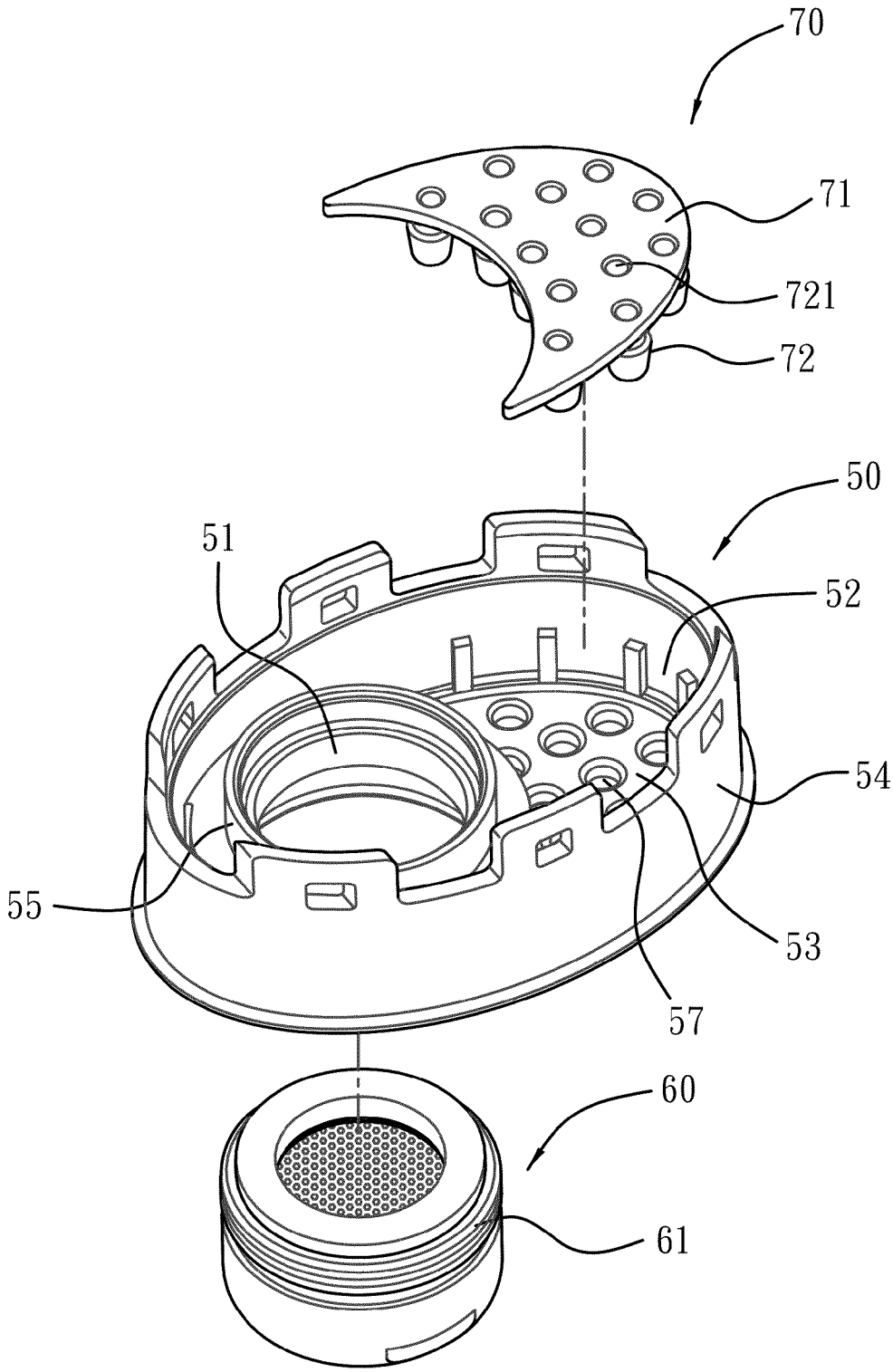
FIG. 10 is a perspective view of a front cover, a first watering element, and a second watering element of the movable spread head in accordance with the preferred embodiment of the present invention.

The front cover 50 is installed in the vacancy 43 of the housing 40 and coupled to the watering member 20 to be proximate to a first compartment 51 and a second compartment 52 as illustrated in FIG. 10 to communicate with the first and the second water orifices 23 and 24 respectively.

The front cover 50 includes a bottom plane 53, a second outer side 54 extended upward around a rim thereof, a second inner side 55 formed therein so as to define the second compartment 52 between the second outer side 54 and the second inner side 55, and define the first compartment 51 on the second inner side 55.

The front cover 50 includes a bottom plane 53 extending out of the second outer side 54.

The second outer side 54 is screwed with the vacancy 43 of the housing 40, and the second outer side 54 and the second inner side 55 engage with the first annular loop 271 of the first outer side 27 of the watering member 20 and the second annular loop 281 of the second inner side 28 individually so that the front cover 50 connects with a lower side of the watering member 20 tightly.

The front cover 50 includes internal screws 56 arranged in the first compartment 51 and a number of spouts 57 disposed on a bottom of the second compartment 52.

The first watering element 60 is installed in the first compartment 51 of the front cover 50 as shown in FIG. 10, such that water flowing from the first water orifice 23 is a first mode of water flow. The first watering element 60 is a water filter and includes external screws 61 formed on an exterior thereof to screw with the internal screws 56 of the first compartment 51 to generate bubbled water flow.

The second watering element 70 is installed in the second compartment 52 of the front cover 50 as illustrated in FIG. 10, such that the water flowing from the second water orifice 24 is a second mode of water flow. The second watering element 70 is a jet panel and includes a plate member 71 received in the second compartment 52 and a plurality of nozzles 72 fixed on the plate member 71. Each of the nozzles 72 passes downward from the spout 57 to form a tunnel 721 to spray water.

The control member 80 includes a pressing tab 81 and a foot 82 extending form a front side of the pressing tab 81 as shown in FIG. 7, the foot 82 includes an actuating portion 83 formed on a distal end of the foot 82 to couple with and drive the connecting portion 33 of the valve core 30, and the pressing tab 81 includes a coupling section 84 disposed on a central portion thereof. The pressing tab 81 includes a first press portion 85 and a second press portion 86 mounted on a top of a rear side and a front side thereof individually.

The coupling section 84 is axially connected with the rotary shaft 45 of the installing space 44 of the housing 40 to form a fulcrum to rotate the housing 40 frontward and rearward.

The actuating section 83 includes a gap 831 so that the foot 82 of the control member 80 passes through the slot 446 of the installing space 44 of the housing 40 to be inserted to the receiving groove 16, thereby engaging with the positioning segment 331 by using the gap 831 and being limited on the stop periphery 332 to movably connect with the valve core 30, such that as the first press portion 85 or the second press portion 86 of the control member 80 is pressed to move, the control member 80 rotates pivotally along the coupling section 84 to actuate the valve core 30 to move frontward and rearward.

The sleeve 90 is fixed in the installing space 44 of the housing 40 as illustrated in FIG. 8 to cover the control member 80, and user can actuate the control member 80 by pressing the sleeve 90. The sleeve 90 includes a number of retaining blocks 91 mounted around the installing space 44 to be retained in the inserting holes 442 of the installing space 44, and an internal top of the sleeve 90 contacts with the reinforcement ribs 441 of the installing space 44.

Figure 11:
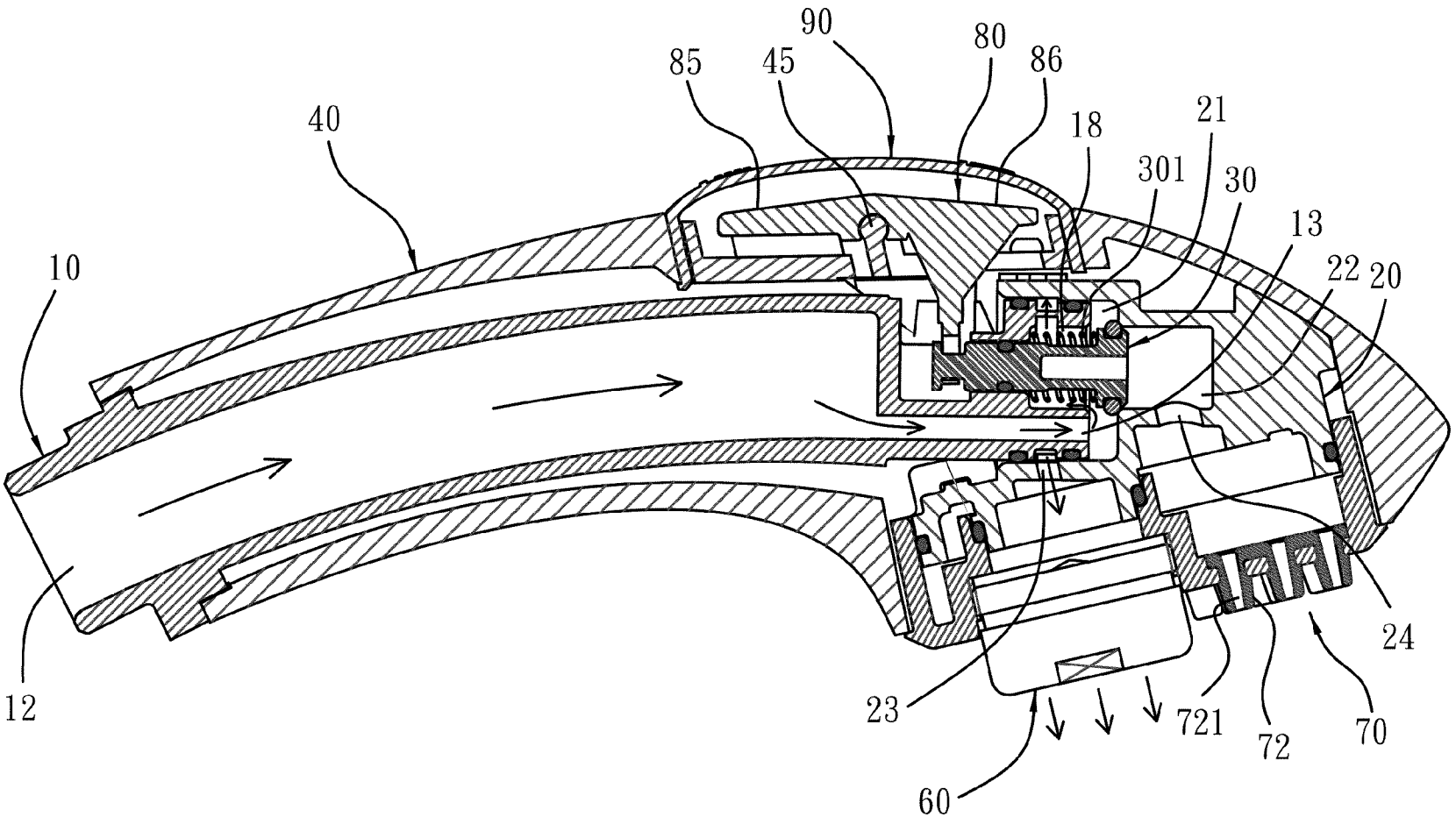
FIG. 11 is a cross sectional view showing bubbled water flow generating from a first watering element in accordance with the preferred embodiment of the present invention.

When water is not fed to the movable spread head of the present invention, the valve core 30 is pushed to move frontward by the elastic element 301 so that the fourth closing portion 32 abuts against the second sealing surface 25 of the second cavity 22 of the watering member 20 tightly as illustrated in FIG. 3, and the control member 80 is actuated to make the second press portion 86 to become upraised, hence when a watering switch is turned on, the water from the inlet 12 of the tubular member 10 flows out of the first watering element 60 to generate bubbled water flow via the outlet 13, the first cavity 21 of the watering member 20, the inner chamber 18 of the tubular member 10, the cutouts 19, and the first water orifice 23 of the watering member 20, as shown in FIG. 11.

Figure 12:
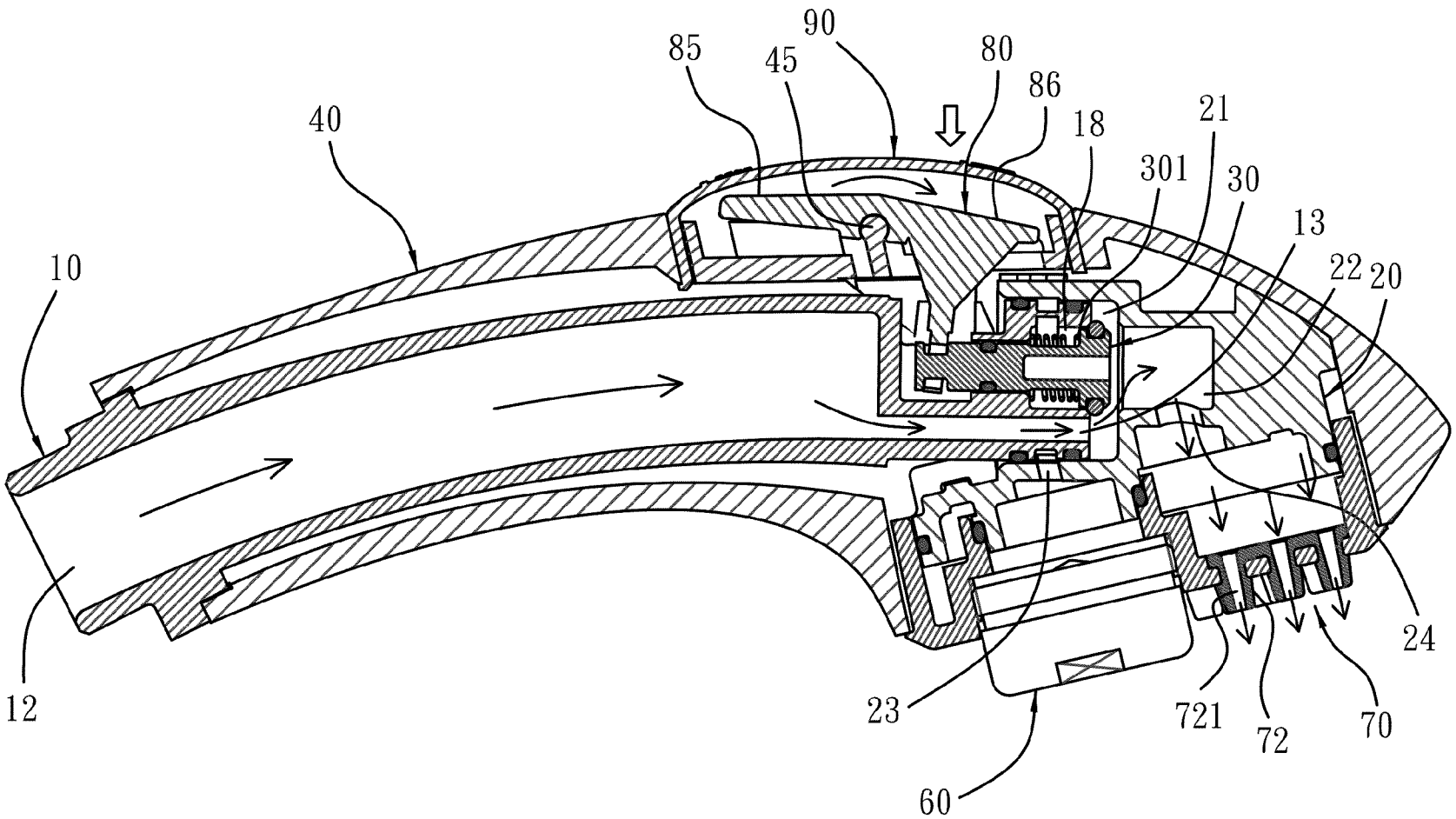
FIG. 12 is a cross sectional view showing jetted water flow generating from a second watering element in accordance with the preferred embodiment of the present invention.

As switching water flow to another level, the sleeve 90 is pressed to actuate the second press portion 86 of the control member 80 as illustrated in FIG. 12 so that the control member 80 rotates downward along the rotary shaft 45 of the installing space 44 of the housing 40 to actuate the valve core 30 to move rearward, therefore the fourth closing portion 32 disengages from the second sealing surface 25 of the watering member 20 until the first sealing surface 181 of the inner chamber 18 of the tubular member 10 is closed completely, and the elastic element 301 is compressed, hence the water from the outlet 13 of the tubular member 10 flows out of the nozzles 72 of the second watering element 70 through the first cavity 21, the second cavity 22, and the first water orifice 24 to generate jetted water flow.

After turning off jetted water flow, the valve core 30 is pushed by the elastic element 301 to move frontward to return bubbled water flow.

During switching the jetted water flow toward the bubbled water flow, the sleeve 90 is pressed to actuate the second press portion 86 of the control member 80 to drive the valve core 30 to move frontward so that the fourth closing portion 32 is biased against the second sealing surface 25 of the second cavity 22 of the watering member 20 again, accordingly the water flow is guided to pass through the first water orifice 23 of the watering member 20 and the first watering element 60 to return bubbled water flow. Therefore, the user can press the first and the second press portions 85 and 86 of the control member 80 to switch the bubbled or jetted water flow freely.

During switching the bubbled water flow toward the jetted water flow, the pressure of the water flow drives the valve core 30 to push against the elasticity of the elastic element 301, thereby the control 80 keeps in a jetted watering level without being pressed.

The valve core 30 is installed to the tubular member 10 in an axial direction to decrease additional components by ways of an internal room of the front end of the tubular member 10, simplifying structure and decreasing size. Furthermore, the watering direction is controlled to be perpendicular to a water feeding direction, obtaining easy operation. The second watering element 70 is arranged to be adjacent to the first watering element 60 so that the second watering element 70 sprays out of water via the nozzles 72, obtaining different types of water supply.

While we have shown and described various embodiments in accordance with the present invention, it is clear to those skilled in the art that further embodiments may be made without departing from the scope of the present invention.

What is claimed is:

1. A movable spread head comprising:

a tubular member including a channel, an inlet and an outlet, both of which are disposed on two ends of the channel respectively; the inlet coupled with a soft pipe in a water tap, the channel including a large diameter first passageway and a small diameter second passageway, and on an outer side of the first passageway being formed the inlet, on an outer side of the second passageway being formed the outlet; the tubular member also including an insulation rim extending on a peripheral wall of the outlet, the second passageway defined between a lower side of the insulation rim and the peripheral wall; the tubular member including an opening mounted on the peripheral wall above an upper side of the insulation rim so that a receiving groove is defined between the opening and the upper side of the insulation rim, and between the upper side of the insulation rim and the peripheral wall being also fixed a hole and an inner chamber, and the hole communicating with the receiving groove; the inner chamber including a first sealing surface arranged on a predetermined position of an outer side thereof; the tubular member further including a first closing portion and a second closing portion secured on an outer surface of the peripheral rim, and including at least one cutout disposed between the first and the second closing portions and to communicate with the inner chamber;

a watering member including a first cavity and a second cavity communicating with each other, a first water orifice and a second water orifice spaced apart from each other; the first water orifice being in communication with the first cavity and the second water orifice communicating with the second cavity, and a periphery of the first cavity engaged with the first and second closing portions of the tubular member, and a bottom wall of the first cavity keeping a certain distance away from the tubular member so that the first cavity communicates with the outlet, and the water orifice communicates with the inner chamber through the cutout, and a second sealing surface formed in the second cavity;

a valve core formed in a post shape and inserting to the inner chamber and the hole of the tubular member axially, the valve core including a third closing portion attached on a central section thereof to retain the hole, and including a fourth closing portion arranged on an outer surface thereof, and a connecting portion disposed on an inner end thereof, such that the connecting portion is forced to actuate the valve core to move along the hole axially; as the fixing portion moves inward, the fourth closing portion abuts against the first sealing surface of the inner chamber so that the outlet of the tubular member communicating with the second water orifice via the first cavity and second cavity in order; as the fixing portion moves outward, the fourth closing portion abuts against the second sealing surface of the first cavity so that the outlet of the tubular member communicates with the second water orifice via the first cavity and second cavity in turn;

an elastic element to push the valve core outward so that the fourth closing portion engages with the second sealing surface of the watering member;

a housing including an internal room to receive the tubular member and the watering member; the internal room communicating with a side pore and a lower vacancy, the tubular member extending out of the side pore, the housing further including an installing space to couple with the tubular member and the watering member, and the installing space including a rotary shaft;

a front cover installed in the vacancy of the housing and coupled to the watering member to be proximate to a first compartment and a second compartment to communicate with the first and the second water orifices respectively;

a first watering element installed in the first compartment of the front cover, such that water flowing from the first water orifice forms a first mode of water flow;

a second watering element installed in the second compartment of the front cover, such that the water flowing from the second water orifice forms a second mode of water flow;

a control member including a coupling section disposed on a central portion thereof and an actuating portion formed on a front side thereof individually, and including a first press portion and a second press portion mounted on a top of a rear side and the front side thereof individually; the coupling section axially connected with the rotary shaft of the installing space of the housing to form a fulcrum to rotate the housing frontward and rearward; the actuating section passing through the installing space of the housing to connect with and actuate the connecting portion of the valve core.

2. The movable spread head as claimed in claim 1 further comprising a sleeve fixed in the installing space of the housing to cover the control member, and user can actuate the control member by pressing the sleeve.

3. The movable spread head as claimed in claim 1, wherein the installing space of the housing includes a mouth between a plurality of projections and a slot arranged on a front side thereof to communicate with the receiving groove of the tubular member.

4. The movable spread head as claimed in claim 1, wherein the tubular member includes an upright post extending upward from a peripheral wall of the receiving groove; the installing space includes a pair of first through apertures between two sides of the slot, the first through apertures screw with first upright posts of the tubular member by using bolts to lock the tubular member in the housing.

5. The movable spread head as claimed in claim 1, wherein the watering member includes two second upright posts extending upward from a predetermined position thereof relative to an outer surface of an upper side of the first cavity; the installing space includes a pair of second through apertures between two sides of the slot, wherein the second through apertures screw with the second upright posts of the watering member via the bolts so that the watering member is locked in the housing.

6. The movable spread head as claimed in claim 1, wherein the first and the second closing portions of the tubular member are comprised of two annular loop members.

7. The movable spread head as claimed in claim 1, wherein the third and the fourth closing portions of the valve core are comprised of two annular loop members.

8. The movable spread head as claimed in claim 1, wherein the connecting portion of the valve core is engaged with the actuating section of the control member in a movable locking manner.

9. The movable spread head as claimed in claim 1, wherein the watering member includes a first outer side extending from a lower side thereof and a second inner side therein; the front cover includes a bottom plane, a second outer side extended upward around a rim thereof, and a second inner side formed therein so as to define the second compartment between the second outer side and the second inner side, and define the first compartment on the second inner side; the watering member includes first and second annular loops fixed on an outer surface thereof individually to engage with the second outer side and the second inner side of the front cover.

10. The movable spread head as claimed in claim 1, wherein the first watering element is a water filter and includes external screws formed on an exterior thereof to screw with the internal screws of the first compartment to generate bubbled water flow.

11. The movable spread head as claimed in claim 1, wherein the front cover includes a number of spouts disposed on a bottom of the second compartment; the second watering element is a jet panel and includes a plate member received in the second compartment and a plurality of nozzles fixed on the plate member; each of the nozzles passes downward from the spout to form a tunnel to spray water.

* * * * *